US008464460B1

(12) United States Patent
Runyan

(10) Patent No.: US 8,464,460 B1
(45) Date of Patent: Jun. 18, 2013

(54) TRANSPORTABLE SHOOTING BENCH AND TARGET

(76) Inventor: Clayton Chance Runyan, Mill Creek, OK (US)

( * ) Notice: Subject to any disclaimer, the term of this patent is extended or adjusted under 35 U.S.C. 154(b) by 201 days.

(21) Appl. No.: 13/068,992

(22) Filed: May 25, 2011

(51) Int. Cl.
*F41C 27/00* (2006.01)

(52) U.S. Cl.
USPC ..... 42/94; 280/656; 296/182.1

(58) Field of Classification Search
USPC ..... 42/94; 280/656, 408, 410; 296/24.3, 296/24.32, 24.4, 24.44, 24.45, 182.1, 168
See application file for complete search history.

(56) References Cited

U.S. PATENT DOCUMENTS

| | | | | |
|---|---|---|---|---|
| 3,647,214 | A * | 3/1972 | Hohmann | 273/392 |
| 5,284,280 | A | 2/1994 | Stonebraker, Sr. | |
| 5,697,180 | A | 12/1997 | Morizio | |
| 6,269,578 | B1 | 8/2001 | Callegari | |
| 6,684,550 | B2 | 2/2004 | Highfill | |
| 6,871,440 | B2 * | 3/2005 | Highfill et al. | 42/94 |
| 6,935,064 | B1 | 8/2005 | Thompson | |
| 7,152,358 | B1 | 12/2006 | LeAnna | |
| 7,219,919 | B2 * | 5/2007 | Tipton | 280/651 |
| 7,536,820 | B2 | 5/2009 | Wade | |
| 7,549,247 | B1 | 6/2009 | Reese | |
| D628,405 | S | 12/2010 | Pippin | |
| 8,061,572 | B2 * | 11/2011 | Myrex | 224/502 |
| 2005/0046112 | A1 * | 3/2005 | Dehart | 273/406 |
| 2006/0208454 | A1 * | 9/2006 | Giesler | 280/415.1 |
| 2007/0182185 | A1 * | 8/2007 | Nichols | 296/26.08 |
| 2008/0231017 | A1 * | 9/2008 | Voves | 280/408 |
| 2011/0266776 | A1 * | 11/2011 | Kapels | 280/656 |

* cited by examiner

*Primary Examiner* — Gabriel Klein
(74) *Attorney, Agent, or Firm* — Randal D. Homburg

(57) ABSTRACT

A trailer mounted shooting bench with a storage container and a detachable target apparatus provides a portable shooting station which is placed in a safe shooting area, with the target apparatus detached from the shooting bench and placed in a selected location prior to the placement of the shooting bench at a selected shooting location. The trailer mounted shooting bench and storage container may also be used while hunting, with the target apparatus remaining attached or set aside. The shooting bench has a storage container built within and upon which the shooting platform is hingeably attached, the shooting bench having one or more seats available for a right handed or left handed shooter to sit while the shooting platform provides a flat level surface, including an arm rest, for a shooter to position themself while shooting at the target apparatus. The storage compartment provides transport storage for firearms, target accessories, ammunition, camping supplies.

13 Claims, 5 Drawing Sheets

TRANSPORTABLE SHOOTING BENCH AND TARGET

CROSS REFERENCE TO RELATED APPLICATIONS

None.

I. BACKGROUND OF THE INVENTION

1. Field of Invention

A trailer mounted shooting bench, storage container and target apparatus provides a portable shooting station, which can be transported to a remote location appropriate for target shooting or hunting, and provides the target attaching to the trailer mounted shooting bench during transport with the target being detached and deployed in a desired location with the trailer mounted shooting bench moved to a separate location, the shooting bench made stationary for targeting and shooting at the target, or used for any general shooting purpose. The shooting bench provides various storage for shooting paraphernalia with an array of options provided for sport shooting or hunting purposes.

2. Description of Prior Art

A preliminary review of prior art patents was conducted by the applicant which reveal prior art patents in a similar field or having similar use. However, the prior art inventions do not disclose the same or similar elements as the present portable shooting bench and target, nor do they present the material components in a manner contemplated or anticipated in the prior art.

Portable shooting benches found in prior art reveal several portable shooting devices which provide a stable surface from which to shoot. In U.S. Pat. No. 5,284,280 to Stonebraker, Sr., a backpack shooting table is disclosed which provides a four legged backpack frame component with independent adjustable legs, a stable horizontal platform upon the frame with an adjustable gun rest. A collapsible and portable gun table with four adjustable and collapsible legs is demonstrated in U.S. Pat. No. 5,697,180 to Morizio, which is approximately the size of a card table. This table also provides an adjustable gun rest, drawers, transport wheels and can be used as a table or an angled upright support. A portable shooting bench assembly is further disclosed in U.S. Pat. No. 7,549,247 to Reese, which provides an adjustable gun rest and a bench seat for seated shooting, the assembly being presented with a wheelbarrow-type frame with two handles near the set for picking up the seat end and a large single wheel near the gun rest end for rolling the assembly. It too has adjustable legs and further provides for seat adjustment for a left handed or right handed shooter.

Several other shooting related devices are presented in prior art that incorporate into a rear vehicle trailer hitch. In U.S. Pat. No. 6,684,550 to Highfill, a clay target thrower is mounted to an arm that extends up and away from a receiver hitch. A seat attached to a horizontal arm having a single adjustable jack and an end defining an adjustable height table top, as shown in U.S. Pat. No. 6,269,578 to Callegari, is connected into a receiver hitch. A near identical receiver hitch mounted device is disclosed in U.S. Pat. No. 6,935,064 to Thompson, except it has a seat that swivels from one side to another and a table top which may be presented for a left handed shooter or a right handed shooter. A free standing shooting table with several horizontally presented surfaces for elbow rests, gun stock rests and other swivel mounted items, including a lower seat, having independent collapsible legs for support, with this device being transported in a receiver hitch when collapsed and partial disassembled. In U.S. Pat. No. 7,536,820 to Wade, a receiver hitch mounted shooting rest is shown with multiple adjustments for height and distance from the tailgate are provided, while U.S. Pat. No. D628,405 to Pippin merely shows a design patent for a receiver hitch mounted shooting table with a vertical height adjustment and foot rest pegs.

II. SUMMARY OF THE INVENTION

For some avid enthusiasts, shooting is a sport. For others, it is training and practice for stationary shooting or hunting for game. Either way, when dealing with the shooting of a rifle or distance shooting, it is important that the rifle be properly sighted in and that the shooting practice occurs to provide for better accuracy for the shooter. It is becoming increasingly difficult to find a location where rifle shooting can be conducted. Seldom anymore does a shooter have ready access to a location on his own property, except in distant rural areas, to safely shoot a rifle that can project a bullet at distances of a mile or more. As discovered in a simple search and revealed above, there have been many inventions which have attempted to address the issue of providing a portable and stable shooting bench for target shooting that can be transported to an area which has been determined to be safe for target shooting and proper rifle sighting.

The present trailer mounted shooting bench, storage container and target apparatus supplies a shooter with a trailer which can be transported by a towing vehicle to a remote location, with the target apparatus being detached from the shooting bench and placed in a safe target location, with the shooting bench being towed to a preferred distance from the target apparatus. The shooting bench may then be used either while attached to the towing vehicle or while standing alone. The shooting bench further provides a basic trailer frame upon which is mounted a bench seat, a storage container with a hinged table top, the table top presenting a surface for both right handed and left handed shooting. Access to the storage container may be obtained through the hinged table top and also through one or more side door panels. Several accessories for the basic trailer mounted shooting bench, storage container and target apparatus are also contemplated for enhanced hunting or target shooting purposes.

III. DESCRIPTION OF THE DRAWINGS

The following drawings are submitted with this utility patent application.

IV. DESCRIPTION OF THE PREFERRED EMBODIMENT

Figure 1:
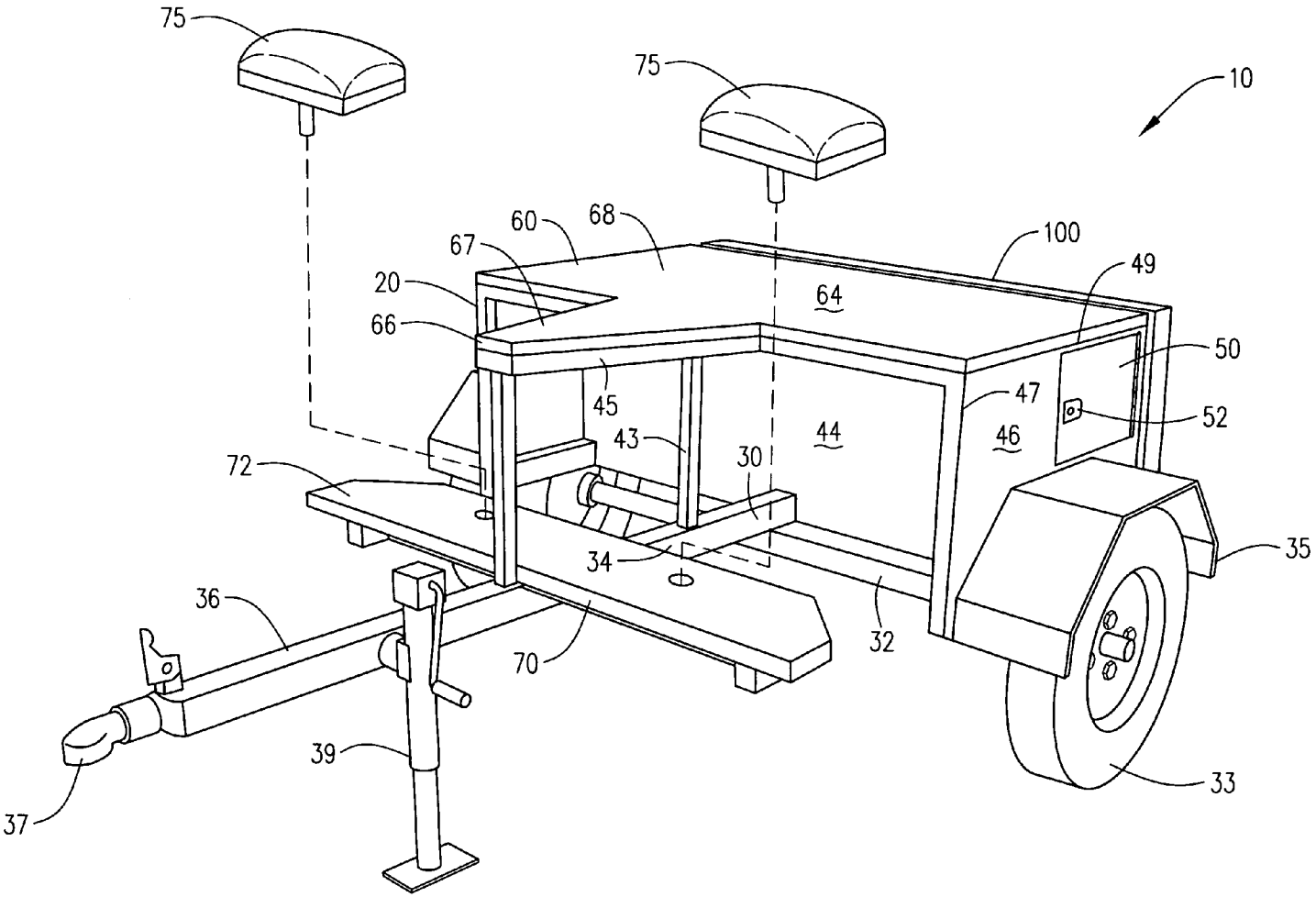
FIG. 1 is a front perspective view of the transportable shooting bench and target apparatus.
Figure 2:
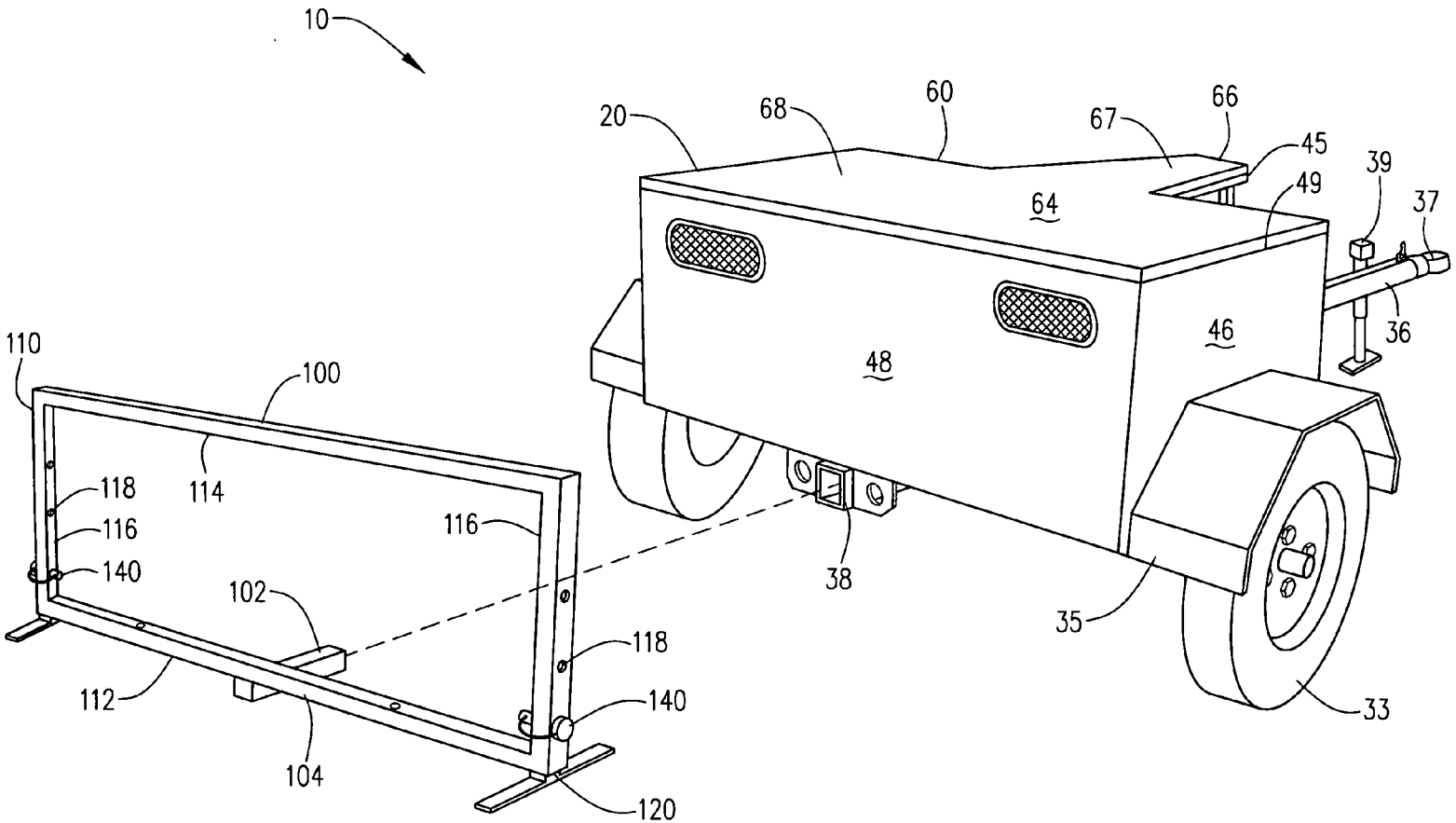
FIG. 2 is a rear perspective view of the shooting bench and target apparatus with the target apparatus detached from the shooting bench.
Figure 3:
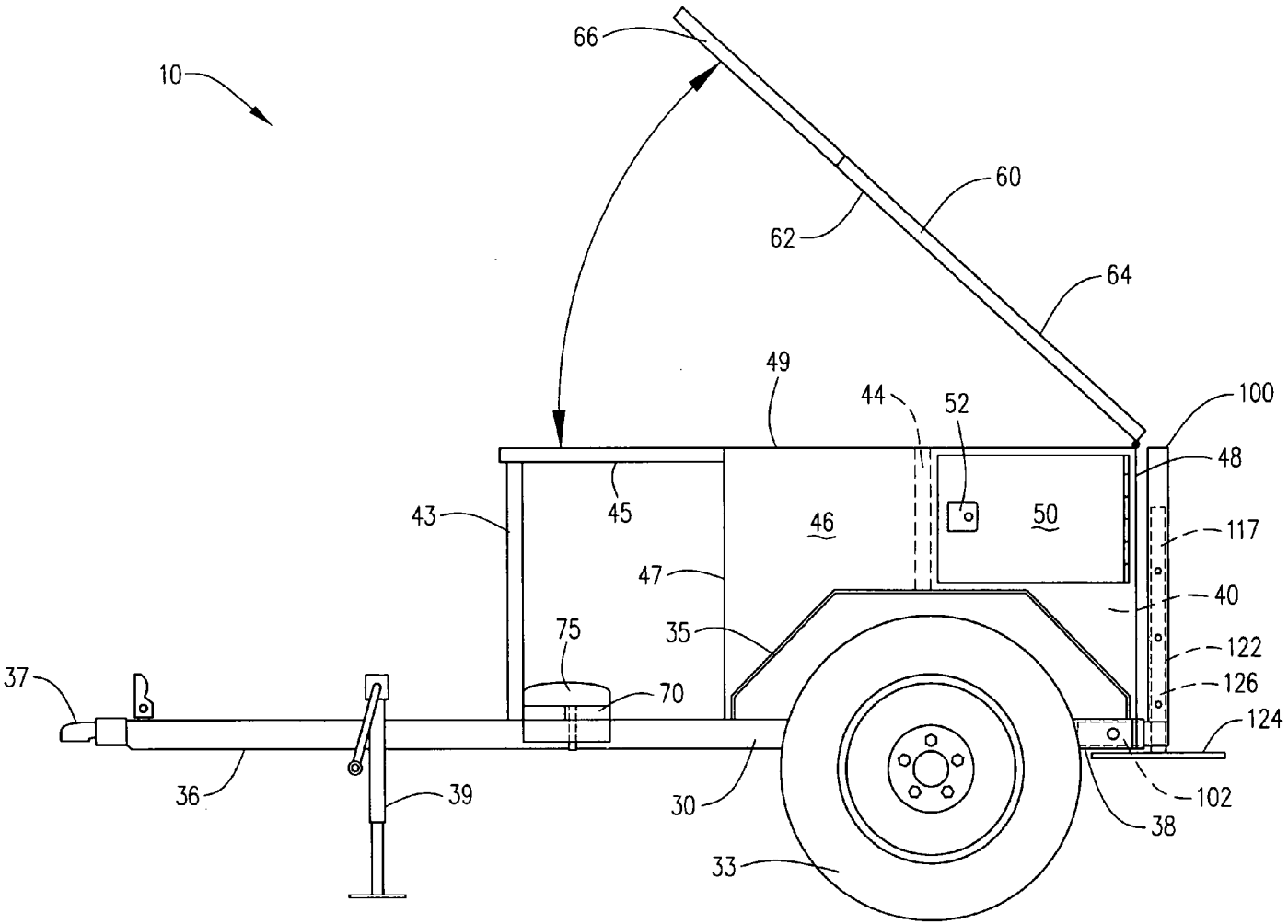
FIG. 3 is a side view of the shooting bench and target apparatus with the target attached to the shooting bench, the hinged lid in a partially raised position, with phantom lines show the rear hitch elements, the retractable target legs, the front panel of the interior compartment and the lower seat pegs.

A trailer mounted shooting bench and storage container and detachable target apparatus 10 providing a portable shooting platform and detachable target for transport to a safe area for shooting and targeting a firearm, as shown in FIGS. 1-5 of the exemplary drawings, the trailer mounted shooting bench and storage container and detachable target apparatus 10 comprising a trailer mounted shooting bench 20 defining a trailer 30 with at least one transverse axle 32 with a set of wheels 33, a frame member 34 to which the at least one transverse axle 32 is attached, the frame member 34 further extending a forward tow bar 36 with a terminal trailer hitch 37 and defining a rear receiver hitch 38, FIG. 2, an enclosed container compartment 40 defining a base floor 42 mounted upon the frame member 34 above the transverse axle 32, a front panel 44, two side panels 46, a rear panel 48 and a shooting platform 60 hingeably attached to the rear panel 48, FIG. 3, the shooting platform 60 being raised to provide access to the enclosed container compartment 40, FIG. 3, and at least one seat 70 attached to the tow bar 36, and the target apparatus 100 defining a box hitch 102 attached to a target frame 104, the target frame 104 having two or more depending adjustable leg supports 120, and an upper frame portion 110 with one or more target devices 130 attached to the upper frame portion 110, wherein said target apparatus 100 attaches the box hitch 102 within the rear receiver hitch 38 in a transport state, FIGS. 2-3, with the adjustable leg supports 120 in a collapsed position, FIGS. 2-3 being towed as an attachment to the trailer mounted shooting bench 20, and detached from the shooting bench 20 with the adjustable leg supports 120 in a deployed position when a preferred target location is selected with the shooting bench 20 further moved to a preferred location from which to fire a firearm at the target apparatus 100.

The enclosed container compartment 40 further comprises the base floor 42, front panel 44, side panels 46 and rear panel 48 formed together and defining an upper rim 49, wherein a weather-tight seal is formed between a lower portion 62 of the shooting platform 60 and the upper rim 49 of the enclosed container compartment 40 where there would be any contact, preventing intrusion of any elements into the enclosed container compartment 60 and to protect the contents, which may constitute expensive firearms, ammunition, target supplies, target binoculars, scopes and other firearm or target accessories or camping gear. In addition to the shooting platform 60, the side panels 46, front panel 44 or rear panel 48 may be provided with side access doors 50, FIGS. 1, 3 and 4, allowing alternate access to the enclosed container compartment 40, the side access doors 50 also provided with another water tight seal and a secured latch means 50. It would be preferred to also provide the enclosed container compartment 40 and the shooting platform 60 with a secure locking means, not shown, to secure the contents of the enclosed container compartment 40.

It would be preferred if the side panels 46 and the trailer frame member 34 are provided with wheel fenders 35 over each wheel 33, attaching to the side panels 46 and the frame member 34 to minimize road debris and dirt from being thrown upon the shooting bench 20, storage container 40 and target apparatus 100 during transport. It would also be preferred that the trailer tow bar 36 be provided with at least one adjustable jack 39, FIG. 3, to provide stability to the shooting bench 20 when not attached to a tow vehicle and also to provide a means of leveling the shooting bench 20 prior to targeting.

Figure 4:
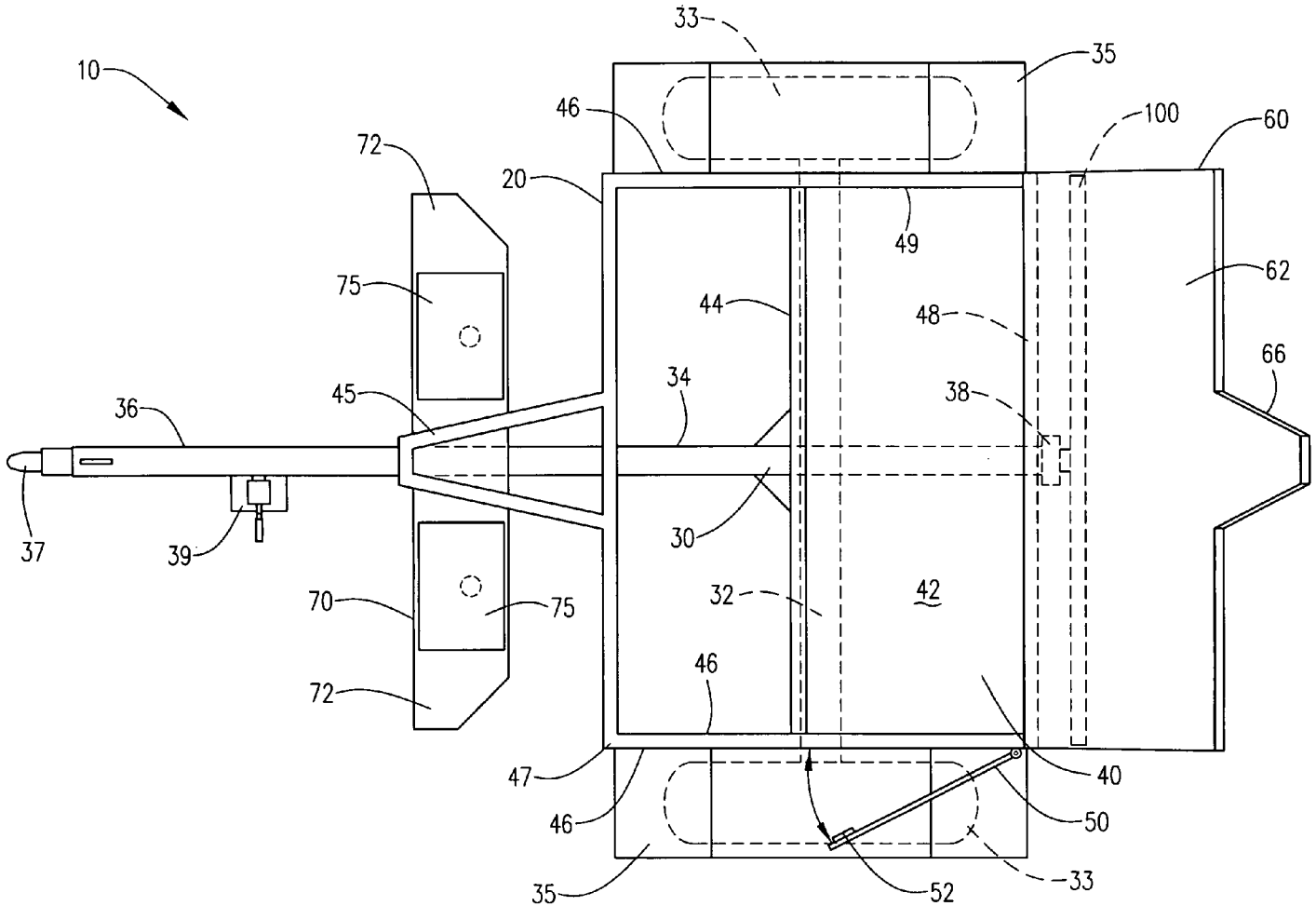
FIG. 4 is a top view of the shooting bench and target apparatus with the target attached to the shooting bench, as indicated by phantom lines, with the hinged lid fully raised, showing the interior compartment and the side access door partially open into the interior compartment.

The shooting platform 60 should preferably be provided with a flat level upper surface 64. It would be preferred that it be provided as configured in FIGS. 1-4, with a forward central extension 66 defining a rear arm rest 67 upon which the stock of a rifle is placed when shooting the firearm, and a large front flat area 68 upon which the shooter may position his front elbow or a gun barrel rest, with access to the forward central extension 66 from either the right side for a left handed shooter, or from the left side for a right handed shooter. This embodiment would include a secondary forward support plate 45 extending forward from the front panel 44 of the enclosed container compartment 40, positioned below the forward central extension 66, with at least one vertical support member 43 placed between the secondary forward support plate 45 and the tow bar 36 near the at least one seat 70, FIG. 1, for additional stability and support for the stock of the rifle. As shown in FIGS. 1 and 4, the at least one seat 70 is actually provided as a lateral bench surface 72 extending sideways underneath the forward central extension 66, FIG. 4, with removable seat pads 75, FIG. 1, to provide a padded seating surface to one or more shooters seated upon the removable seat pads 75. It would be preferred that the front panel 44 be located partially behind a forward edge 47 of the side panels 46 in the enclosed container compartment 40, FIGS. 1, 3 and 4, which would allow for additional leg room for a seated shooter and allow for the positioning of the shooter farther forward onto the shooting platform 60.

Figure 5:
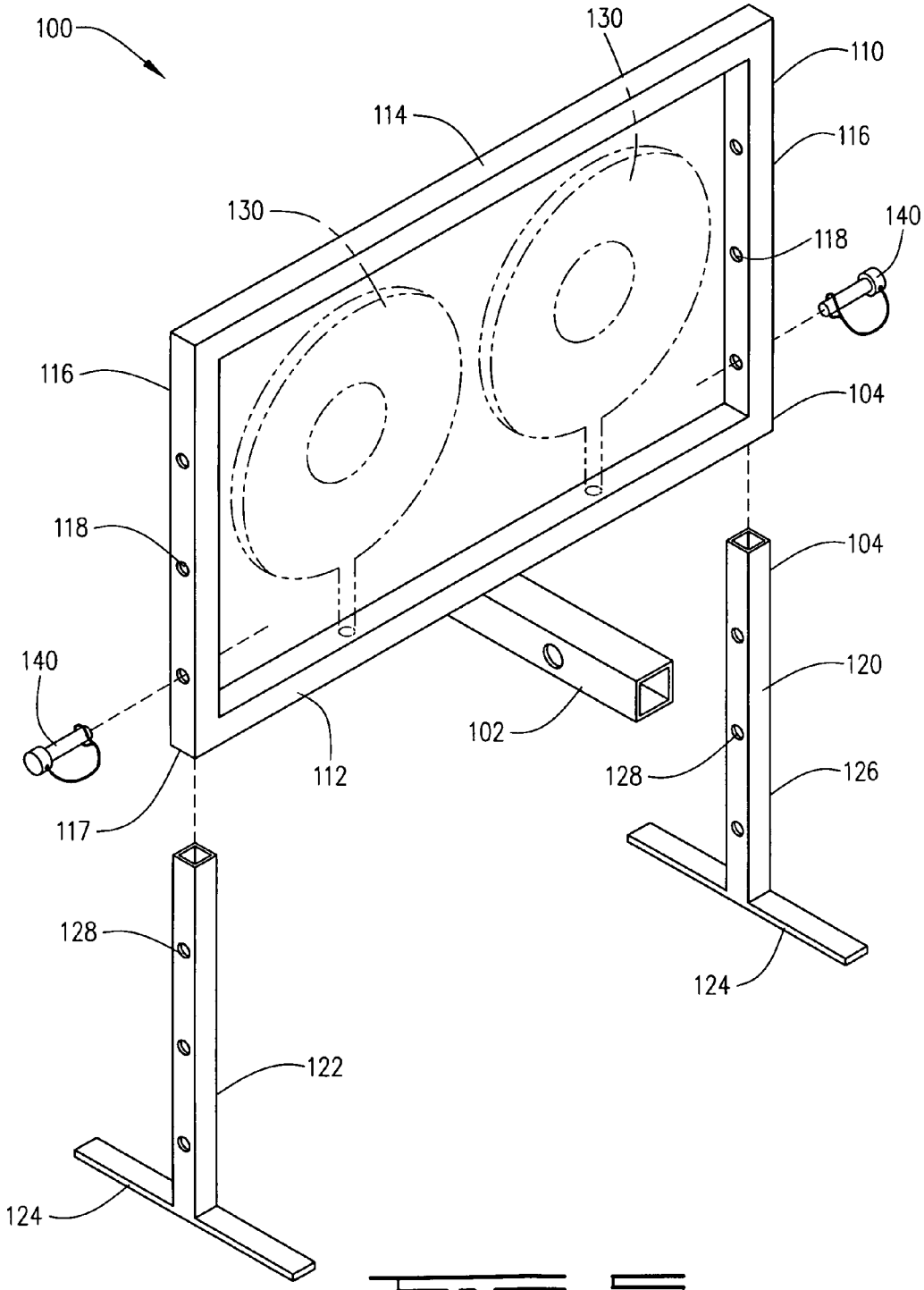
FIG. 5 is an isolated exploded view of the components of one embodiment of the target.

The target apparatus 100 may further define the adjustable leg supports 120 provided as an equal T-shaped legs 122 defining a base 124 and upper extension 126 with a plurality of transverse bores 128, FIG. 5. In this disclosed embodiment, the target frame 104 is a rectangle-shaped frame defining a lower member 112, two hollow side members 116 and an upper member 114. The two side members 116 define a hollow shaft 117 within which each upper extension 126 of each leg support 120 is slidably inserted, each side member 116 also provide with a plurality of transverse bores 118, the transverse bores 128, 118, of the adjustable legs supports 120 and the respective side members 116 held in a selected position by respective locking pins 140, FIG. 5. The target frame 104 may suspend or support attached target devices 130, FIG. 5, movable target devices or provide support for the suspension of disposable paper or fabric targets.

In addition to the disclosed features of the trailer mounted shooting bench and storage container and target apparatus 10 shown in the drawings, it is contemplated that numerous accessories and features could be included within the scope of this shooting bench. For example, to further protect the shooting bench 20 and target apparatus 100 during transport, a form fitted cover could be provided to cover the entire bench and target apparatus during travel and while stored. The shooting bench 20 might also be provided with a collapsible canopy to shade the shooting bench 20 from sunlight and also protect the shooter using the shooting bench from inclement weather, including rain or snow. The secondary forward support plate 45 or the side panels 46 may be provided with one or more sliding drawers below the shooting platform 60 to store supplies, ammunition or gunsmith and repair tools.

The trailer mounted shooting bench and storage container and target apparatus 10 may also be provided with a camouflage cover or tent to convert the shooting bench 20 and enclosed storage container 40 into a blind for hunting purposes, the trailer mounted shooting bench and storage container and target apparatus 10 set up at a hunting location. The target apparatus 100 may also be provided with several options associated with the shooting bench 20, which may include a remote cable system which allows for a control appliance located on the shooting bench 20 which would activate a system within the target apparatus 100 to provide target movement or target recovery while shooting or for measuring an accurate distance between the target apparatus 100 and the shooting bench 20. This may also be accomplished through a wireless transmission means.

While the trailer mounted shooting bench and storage container and target apparatus 10 has been particularly shown and described with reference to a preferred embodiment thereof, it will be understood by those skilled in the art that changes in form and detail may be made therein without departing from the spirit and scope of the invention.

What is claimed is:

1. A trailer mounted shooting bench and storage container and detachable target apparatus providing a portable shooting platform and detachable target for transport to a safe area for shooting and targeting a firearm, the trailer mounted shooting bench and storage container and detachable target apparatus comprising:

a trailer defining a frame member with a trailer hitch and a rear receiver hitch and having at least one transverse axle having outer wheels, said axle mounted to the frame member;

an enclosed container compartment mounted upon said frame member;

a shooting platform hingeably mounted to said enclosed container compartment and providing a flat upper surface, said shooting platform elevated to provide access to said closed container compartment; and a target apparatus defining a box hitch attached to a target frame and a shooting target attached to the target frame, said target frame further providing two or more depending adjustable leg supports, said box hitch retained within said rear receiver hitch of said trailer mounted shooting bench during transport with said adjustable leg supports in a retracted position, wherein said target apparatus may be detached from said shooting bench with said adjustable leg supports extended from said target apparatus into a set position when a location is chosen, with said shooting bench further moved to another chosen location from which to fire a firearm at the target apparatus.

2. The trailer mounted shooting bench and storage container and detachable target apparatus as disclosed in claim 1, said closed container compartment further comprising at least one side access door providing alternate access to said enclosed container compartment, said at least one side access door having a secured latch means.

3. The trailer mounted shooting bench and storage container and detachable target apparatus as disclosed in claim 1, said shooting platform further comprising:

a forward central extension defining a rear arm rest and a front flat area providing a flat level surface upon which a shooter may fire a firearm, with access to said forward central extension from either a right side for a left handed shooter, or from a left side for a right handed shooter.

4. The trailer mounted shooting bench and storage container and detachable target apparatus as disclosed in claim 1, further comprising a lateral bench surface mounted to said frame member of said trailer, said lateral bench surface located between said shooting platform and said trailer hitch, said lateral bench surface including removable seat pads providing a padded seating surface to a shooter thereon.

5. A trailer mounted shooting bench and storage container and detachable target apparatus providing a portable shooting platform and detachable target for transport to a safe area for shooting and targeting a firearm, the trailer mounted shooting bench and storage container and detachable target apparatus comprising:

a trailer defining a frame member having a forward tow bar with a trailer hitch and a rear receiver hitch, at least one transverse axle having outer wheels, said axle mounted to the frame member, wheel member attached over each said wheel, and an adjustable jack mounted to said tow bar near said trailer hitch;

an enclosed container compartment mounted upon said frame member, said container compartment defining a base floor, a front panel, two side panels and a rear panel forming an upper rim;

a shooting platform hingeably mounted to said rear panel, said shooting platform having a lower portion forming a weather-tight seal with said upper rim of said enclosed container compartment, and providing a flat upper surface which further defines a rear arm rest and a front flat area;

at least one seat mounted upon said tow bar between said shooting platform and said trailer hitch; and a target apparatus defining a box hitch attached to a target frame, said target frame further providing an upper frame portion to which a shooting target is attached, said upper frame supported upon the ground by two or more depending adjustable leg supports, said box hitch retained within said rear receiver hitch of said frame member of said trailer mounted shooting bench during transport and said adjustable leg supports in a retracted position, wherein said target apparatus may be detached from said shooting bench with said adjustable leg supports extended from said target apparatus into a set position when a location is chosen, with said shooting bench further moved to another chosen location from which to fire a firearm at the target apparatus.

6. The trailer mounted shooting bench and storage container and detachable target apparatus as disclosed in claim 5, said closed container compartment further comprising at least one side access door within at least one side panel allowing alternate access to said enclosed container compartment, said at least one side access door forming a water tight seal between said side access door and said side panel, said at least one side access door having secured latch means.

7. The trailer mounted shooting bench and storage container and detachable target apparatus as disclosed in claim 5, said shooting platform further comprising a forward central extension defining a rear arm rest and a front flat area providing a flat level surface upon which a shooter may fire a firearm, with access to said forward central extension from either a right side for a left handed shooter, or from a left side for a right handed shooter.

8. The trailer mounted shooting bench and storage container and detachable target apparatus as disclosed in claim 5, said shooting platform further comprising:

a forward central extension defining a rear arm rest and a front flat area providing a flat level surface upon which a shooter may fire a firearm, with access to said forward central extension from either a right side for a left handed shooter, or from a left side for a right handed shooter; and a secondary forward support plate extending forward from said front panel of said enclosed container compartment, positioned below said forward central extension, with at least one vertical support member placed between said secondary forward support plate and said tow bar near said at least one seat to support said forward central extension.

9. The trailer mounted shooting bench and storage container and detachable target apparatus as disclosed in claim 5, said at least one seat is a lateral bench surface extending sideways, said lateral bench surface providing removable seat pads to provide a padded seating surface to a shooter thereon.

10. The trailer mounted shooting bench and storage container and detachable target apparatus as disclosed in claim 5, wherein said front panel is positioned behind a forward edge of said side panels of said enclosed container compartment, therein providing additional leg room for a seated shooter and allowing a more rear positioning of the shooter into the shooting platform.

11. The trailer mounted shooting bench and storage container and detachable target apparatus as disclosed in claim 5, wherein said target apparatus further comprising:

said adjustable leg supports forming at least two equal T-shaped legs defining a base and upper extension with a plurality of transverse bores;

said upper frame portion having a rectangle-shape and defining a lower member, two side members and an upper member, each said side member further providing a hollow shaft within which each said upper extension of each said T-shaped leg is slidably inserted, each said side member also providing at least one transverse bore, said transverse bores of said upper extension and respective side member fixed in a selected position by respective locking pins through said aligned transverse bores.

12. The trailer mounted shooting bench and storage container and detachable target apparatus as disclosed in claim 5, further comprising:

said shooting platform having a forward central extension defining a rear arm rest and a front flat area providing a flat level surface upon which a shooter may fire a firearm, with access to said forward central extension from either a right side for a left handed shooter, or from a left side for a right handed shooter;

said at least one seat is a lateral bench surface extending sideways on each side of said rear arm rest of said forward central extension, said lateral bench surface providing a removable seat pad on each side of said rear arm rest for a shooter to sit thereon; and said front panel of said closed container compartment positioned behind a forward edge of said side panels of said enclosed container compartment, providing additional leg room for a seated shooter upon either removable seat pad.

13. The trailer mounted shooting bench and storage container and detachable target apparatus as disclosed in claim 5, further comprising:

said shooting platform having a forward central extension defining a rear arm rest and a front flat area providing a flat level surface upon which a shooter may fire a firearm, with access to said forward central extension from either a right side for a left handed shooter, or from a left side for a right handed shooter;

said at least one seat is a lateral bench surface extending sideways on each side of said rear arm rest of said forward central extension, said lateral bench surface providing a removable seat pad on each side of said rear arm rest for a shooter to sit thereon;

said front panel of said closed container compartment positioned behind a forward edge of said side panels of said enclosed container compartment, providing additional leg room for a seated shooter upon either removable seat pad; and said target apparatus providing said adjustable leg supports forming at least two equal T-shaped legs defining a base and upper extension with a plurality of transverse bores, and said upper frame portion having a rectangle-shape and defining a lower member, two side members and an upper member, each said side member further providing a hollow shaft within which each said upper extension of each said T-shaped leg is slidably inserted, each said side member also providing at least one transverse bore, said transverse bores of said upper extension and respective side member fixed in a selected position by respective locking pins through said aligned transverse bores.

* * * * *